US005346271A

United States Patent [19]

Erickson

[11] Patent Number: 5,346,271

[45] Date of Patent: Sep. 13, 1994

[54] CARRIER FOR CONTAINERS

[75] Inventor: Richard W. Erickson, Pomona, Calif.

[73] Assignee: International Omni-Pac Corp., Walnut, Calif.

[21] Appl. No.: 22,142

[22] Filed: Feb. 25, 1993

[51] Int. Cl.[5] ..... B65D 71/00

[52] U.S. Cl. ..... 294/87.2; 206/151; 206/162; 294/159

[58] Field of Search ..... 294/31.2, 87.2–87.28, 294/159, 167, 169, 170; 206/139, 143, 145, 147, 148, 150, 151, 162, 163, 199, 201, 427, 428; 215/100 A

[56] References Cited

U.S. PATENT DOCUMENTS

| | | | |
|---|---|---|---|
| 2,409,684 | 10/1946 | Jenkins | 294/87.22 |
| 3,261,498 | 7/1966 | Erickson . | |
| 3,311,252 | 3/1967 | Swartwood et al. | 294/31.2 X |
| 3,421,790 | 1/1969 | Carson | 294/87.26 |
| 3,463,536 | 8/1969 | Updegraff et al. | 294/31.2 |
| 4,090,729 | 5/1978 | Erickson | 294/31.2 |
| 4,093,295 | 6/1978 | Erickson | 294/87.2 |
| 4,159,841 | 7/1979 | Calvert | 294/87.2 |
| 4,231,605 | 11/1980 | Newman | 294/87.2 |
| 4,235,468 | 11/1980 | Erickson | 294/87.2 |
| 4,247,142 | 1/1981 | Erickson | 294/87.2 |
| 4,429,766 | 2/1981 | Erickson | 294/87.2 |
| 4,453,630 | 6/1984 | Helms et al. | 294/87.2 X |
| 4,471,987 | 9/1984 | Erickson | 294/87.2 |
| 4,523,677 | 6/1985 | Schurmann | 294/87.2 X |
| 4,634,002 | 1/1987 | Delonghi | 294/87.2 X |
| 4,793,647 | 12/1988 | Marvin | 294/87.2 |
| 4,911,289 | 3/1990 | Bird | 294/87.2 X |

FOREIGN PATENT DOCUMENTS

| | | | |
|---|---|---|---|
| 77893 | 1/1951 | Norway | 294/87.2 |

*Primary Examiner*—Johnny D. Cherry
*Attorney, Agent, or Firm*—Boniard I. Brown

[57] ABSTRACT

A carrier for relatively heavy liquid containers, such as half-gallon bottles and gallon jugs, has container holders in the form of split collars that hold the containers by their necks and are pivotally attached to a bridge section by which the carrier is supported in normal carrying position to prevent accidental release of the containers from the carrier by twisting of the collars relative to the container necks in response to bending of the bridge section under the weight of the containers.

23 Claims, 2 Drawing Sheets

CARRIER FOR CONTAINERS

BACKGROUND OF THE INVENTION

1. Field of the Invention

This invention relates generally to container carriers and more particularly to a carrier for relatively large containers, such as half-gallon bottles and gallon jugs.

2. Prior Art

Containers of the kind with which this invention is concerned are widely used to package a great variety of liquids for commercial sale. Owing to increasing consumer interest in purchasing bulk quantities of many consumer products, because of the monetary savings involved, such containers have increased substantially in size and hence weight. For example, beverages such as milk, soft drinks, and water, and other liquids, such as swimming pool chemicals, are now commonly sold in half gallon bottles and gallon jugs. These containers are commonly fabricated from plastic or glass by a molding process, such as blow molding, and have an upper reduced neck through which the container contents are initially introduced into the container and later dispensed from the container. The open upper end of this neck is normally closed by a removable cap, such as a screw cap which is removable by rotating the cap or by a plastic cap having a pull tab which is torn off to release the cap for removal. Circumferentially surrounding the neck just below the lower edge of the cap is a shoulder, referred to as a "neck ring" or "chime".

A variety of carriers have been devised for holding two or more containers of this kind arranged side by side in a row or rows. For example, one type of carrier has a bottom tray on which the containers rest and an upper handle fixed to the tray for holding the carrier. In some cases, the carrier includes means at some level above the tray for supporting the containers laterally. One example of a carrier of this type is disclosed in U.S. Pat. No. 3,261,498. Another type of carrier for such containers has a relatively rigid body, commonly a one piece molded plastic body, having spaced collar-like portions which receive the necks of the containers. These collar-like portions, or simply collars as they are referred to herein, include inner, circumferentially spaced, resiliently flexible neck engaging elements which yield axially and radially to permit passage of the container necks and neck rings through the collars. The elements then spring inwardly to engage the under sides of the neck rings in such a way as to support the containers in suspended fashion with most of the container length hanging below the carrier. Examples of carriers of this latter type are described in U.S. Pat. Nos. 4,090,729, 4,093,295, 4,235,468, 4,247,142, 4,249,766, and 4,471,987.

SUMMARY OF THE INVENTION

The present invention provides an improved carrier for containers of the kind described, that is containers having upper necks circumferentially surrounded by an annular shoulder or neck ring. The carrier has certain improved features which uniquely adapt the carrier to its intended purposes of securely supporting containers, such as half gallon and gallon bottles and jugs. According to one feature of the invention, the improved carrier has container holders pivotally joined to an intervening bridge section by which a container package including the carrier is supported or held. While this bridge section is made relatively stiff to resist bending, it is subject to some bending by the weight of the container supported on the carrier. These container holders are constructed to receive the necks of containers arranged side by side in a row, or rows, and to engage the under sides of their neck rings in such a way as to support the containers in suspended side by side relation. The holders have central axes which are normally parallel to one another when the carrier is empty and in its normal unstressed configuration. The presently preferred carrier embodiment described herein is designed to hold two containers. It will become evident as the description proceeds, however, that the improved features of the invention may be embodied in carriers for more than two containers.

When a container package consisting of containers and a container carrier according to this invention rests on a supporting surface, the container holders are disposed relative to the container necks with the holder axes parallel to one another and aligned with the axes of the container necks. When the container package is carried by the carrier bridge section, the weight of each container in the package acts downwardly on the corresponding holder. The container weight then tends to bend the portion of the bridge section adjacent the holder downwardly in a certain plane of the bridge section, referred to herein as a bending plane, which plane would be substantially vertical in the normal carrying position of the carrier. If the holders were rigidly joined to the bridge section, the holders would bend down with their adjacent portions of the bridge section in such a way that the holders would undergo, in effect, combined downward translation in the bending plane and rotation about an axis transverse to this plane. This rotation of the holders would occur relative to the suspended containers, which would tend to remain vertical because of the force of gravity on the containers, and would tend to twist the holders past the container neck rings and thereby inadvertently release the containers from the carrier.

According to the present invention, this problem of inadvertent release of the containers from the carrier is avoided by pivotally mounting each holder on the carrier bridge section on a pivot axis intersecting the holder axis transverse to the bending plane in which the respective adjacent portion of the bridge section bends under the weight of the container supported in the holder. The pivotal connections between the bridge section and holders permit the holders to remain coaxial with, and thereby firmly secured to, the container necks during downward bending of the adjacent bridge portions by the weight of the containers.

The container holders of the preferred carrier described herein are annular collars having relatively rigid outer rings and relatively stiff but resiliently flexible container-neck-engaging elements spaced circumferentially about and extending inwardly from the rings toward the central axes of the collars. These container-engaging elements are conical segments which incline inwardly toward the central axes and axially toward the normally upper sides of the collars and have inner edges which bear against the container necks just below their neck rings. According to another feature of this invention, these container-engaging elements or segments have upper surfaces which intersect the inner edges of the gripping elements along relatively sharp corner junctures that engage the under sides of the container neck rings to securely support the containers vertically and lower surfaces which join the inner edges of the elements along convex rounded junctures to aid entrance of the container necks and neck rings through the collars when placing the carrier on the containers. The collars include at least one relatively large gap or space between adjacent gripping engaging elements for accommodating pull tabs on the container caps.

A further feature of the invention resides in flange-like tabs which extend outwardly from the collars. These tabs are arranged so that a person may squeeze a collar tab and the upper end of the container neck positioned in the collar between the thumb and forefinger of one hand in such a way as to force the collar upwardly from the container neck.

The preferred carrier embodiment described herein is a one piece molded plastic carrier whose pivotal connections comprise integral torsionally resilient connections between the bridge section and the container holders or collars. In this preferred embodiment, the bridge section of the carrier has generally yoke-shaped arms which straddle each collar and are pivotally attached to the collar rings by integral torsionally resilient pivot connections. Other objects and features of the invention will become evident as the description proceeds.

DESCRIPTION OF THE PREFERRED EMBODIMENT

Figure 1:
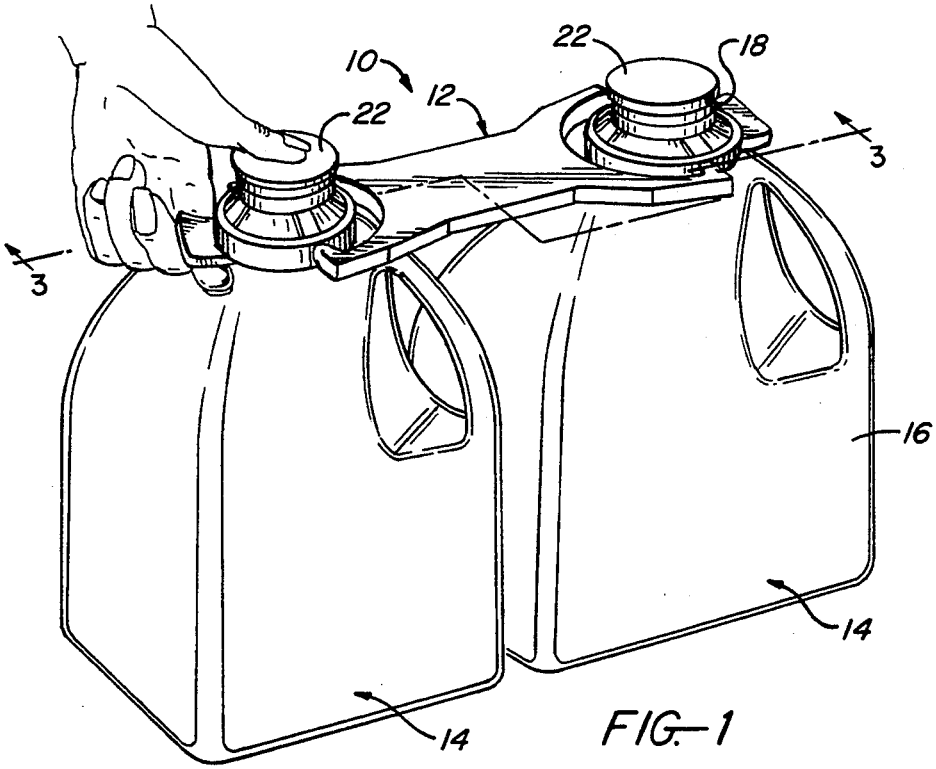
FIG. 1 is a perspective view of a carrier according to the invention mounted on two jugs, such as milk jugs, to form a jug twin pack.
Figure 2:
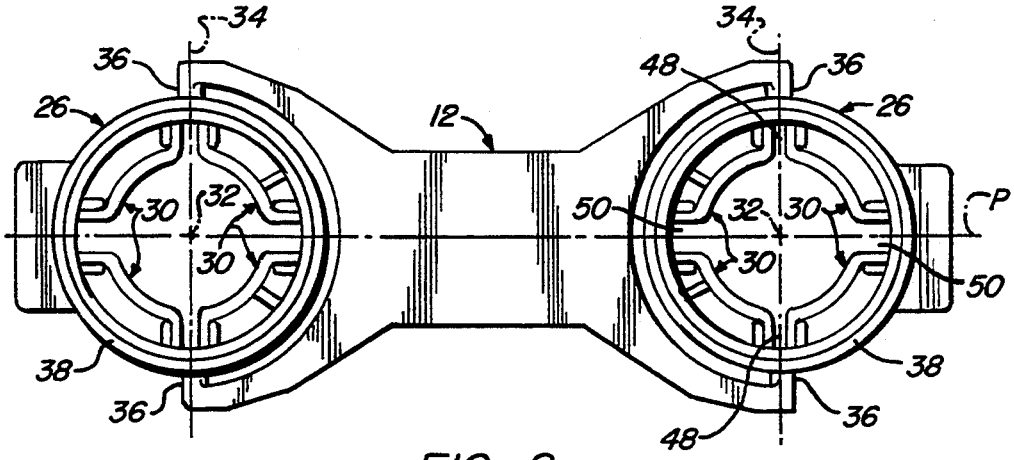
FIG. 2 is a top plan view of the carrier in FIG. 1.

Turning now to these drawings, there is illustrated a container package 10 including an improved carrier 12 according to the invention attached to relatively large containers 14 of the kind referred to earlier. The illustrated containers are plastic gallon containers, commonly referred to as jugs, which are fabricated by a blow molding process and widely used as containers for milk, water, swimming pool chlorine, and other liquids. Each container 14 has a lower container body 16 and an upper neck 18 circumferentially surrounded by an annular shoulder 20, referred to as a neck ring or "chime". The neck 18 is used to initially fill the container and later to dispense the contents from the container and is normally sealed by a removable cap 22.

Carrier 12 comprises a pair of container holders 26 joined by an intervening relatively rigid bridge section 28. Bridge section 28 forms a grip portion or handle by which the carrier may be supported or held in the manner shown in FIG. 4. Holders 26 are constructed and arranged to receive the necks 18 of the containers 14 and have circumferentially spaced, resiliently flexible container-engaging elements 30 for engaging the container necks just below the container neck rings 20 in the manner best shown in FIGS. 3 and 5. These container-engaging elements support the two containers 14 in suspended side by side relation with the most of the length of the containers disposed below the carrier, as shown. The holders 26 have central axes 32 located in a common longitudinal plane P of the carrier.

Figure 3:
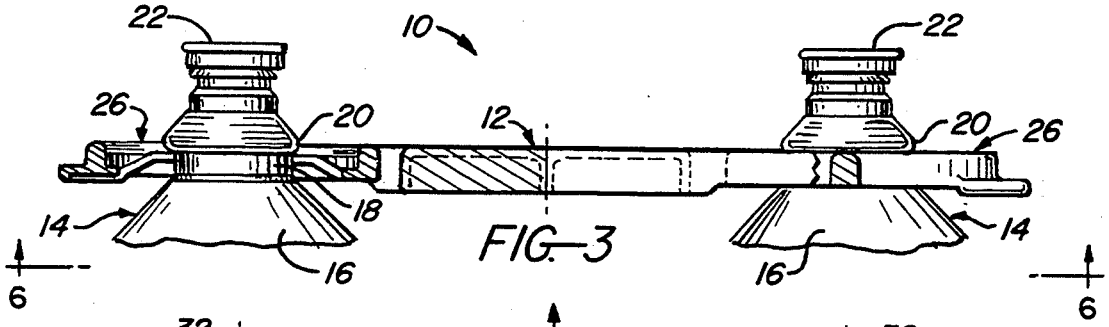
FIG. 3 is a section taken on line 3—3 in FIG. 1.
Figure 4:
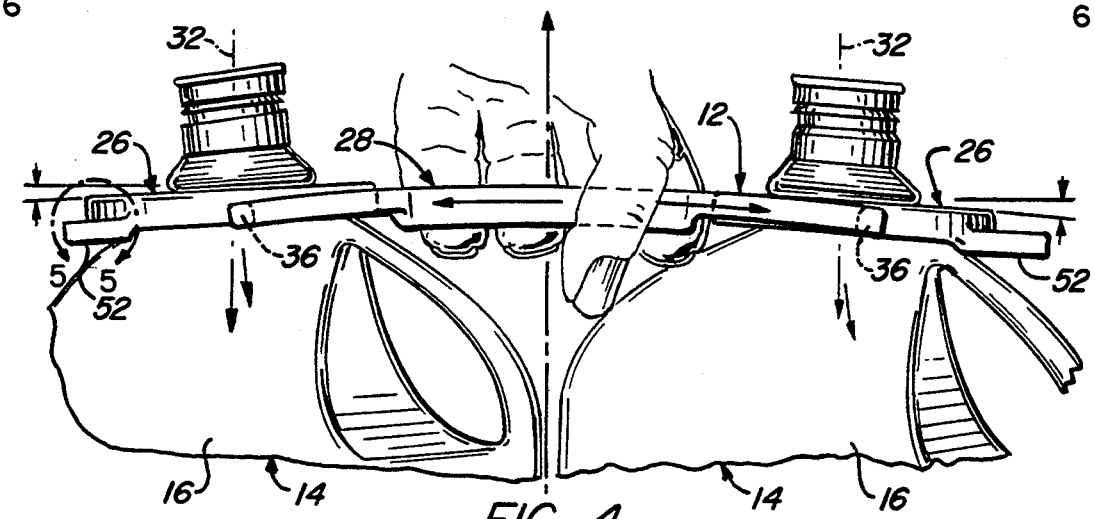
FIG. 4 is a fragmentary side view of the twin pack in FIG. 1, illustrating how the pack is held.
Figure 6:
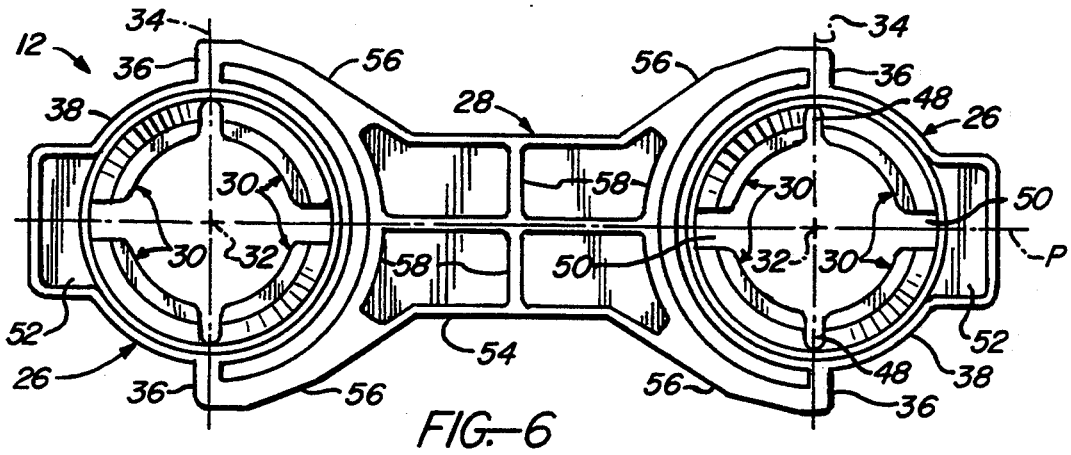
FIG. 6 is a view of the underside of the carrier taken at line 6—6 in FIG. 3.

FIG. 3 illustrates the container package 10 when it rests on a supporting surface, that is, when the two containers 14 of the package rest on the surface. The container holders 26 are then coaxial with the container necks 18, and the holder axes 32 are parallel to one another, perpendicular to the longitudinal axis of the bridge section 28, and aligned with or colinear with the axes of the container necks, as shown. When the container package 10 is grasped and lifted by the carrier bridge section 28, as shown in FIG. 4, the weights of the two containers 14 act downwardly on their holders 26 and thereby tend to bend the portions of the bridge section adjacent the holders, in this case the two ends of the bridge section, downwardly in bending planes (the plane of the paper in FIG. 4 and the plane P in FIG. 6) which are substantially vertical when the carrier occupies its normal carrying position of FIG. 4. While the bridge section is constructed to resist such bending, never-the-less, the opposing forces exerted on the carrier, i.e. the upward lifting force exerted on the bridge section and the downward gravitational forces on the containers, bend the two ends of the bridge section downwardly, as shown in FIG. 4, until further bending is prevented by either the bending resistance of the bridge section or lateral abutment of the lower ends of the two containers.

If the holders 26 were rigidly joined to the bridge section 28, they would bend downwardly with the ends of the bridge section in such a way that the holder axes 32 would remain substantially perpendicular to their respective bridge section ends, and the holders would effectively undergo combined downward translation in the bending plane P and rotation about axes 34 normal to this plane. This rotation of the holders would occur in opposite directions about axes 34, and the holder axes 32 would rotate in the plane P from their normal parallel positions in such a way that the upper ends of these axes would move away from one another and the lower ends of the axes would move toward one another. Gravity, on the other hand, would tend to maintain the containers 14 vertical. As a consequence, if the holders 26 were rigidly joined to the carrier bridge section 28, downward bending of the holders with the ends of the bridge section would tend to rotate the holders from their normal positions on the container necks 18 and thereby twist the holders past the container neck rings 20 with resultant inadvertent release of the containers from the carrier.

According to the present invention, this problem of inadvertent release of the containers 14 from the carrier 12 is avoided by providing pivotal connections 36 between the container holders 26 and bridge section 28. These pivotal connections permit the holders to pivot on the axes 34 relative to the bridge section and thereby remain coaxially aligned with the container necks 18 during downward bending of the ends of the bridge section by the weight of the containers.

Referring now in more detail to the preferred inventive embodiment illustrated in the drawings, each carrier holder 26 comprises a split annular collar including an outer relatively rigid ring 38. The container engaging elements 30 of each collar comprise four generally conically tapered segments integrally joined to and spaced circumferentially about the collar ring 38. These segments are relatively stiff but resiliently flexible axially of the collar. As shown best in FIG. 5, each collar segment 30 has a radially outer conically tapered portion 40 which inclines radially inward toward the collar axis 32 and axially toward the normally upper side of the collar and a relatively flat, radially inner portion 42. The radially inner portions 42 of the four segments 30 are disposed in a common plane normal to the collar axis 32.

The collars 26 have the following features whose functions will be explained presently. The collar segments 30 have upper surfaces which intersect the radially inner edges of the respective segments along relatively sharp junctures or edges 44. The collar segments have lower surfaces which join the inner edges of the segments along rounded convex junctures 46. The segments of each collar are circumferentially spaced so as to provide between the adjacent segments two relatively narrow, diametrically opposed gaps 48 aligned laterally of the carrier and two relatively wide diametrically opposed gaps 50 aligned lengthwise of the carrier. Each collar has a flange-like tab 52 projecting outwardly from the side of the collar ring 38 diametrically opposite the carrier bridge section 28.

The carrier bridge section 28 is relatively flat and has a thickness about equal to the axial thickness of the collars 26. The bridge section has a generally rectangular central section 54 and integral yoke-shaped arms 56 at opposite ends of the central section. The underside of the central section has reinforcing ribs 58 along the edges and across the center of the section which reinforce the bridge portion against bending. The yoke arms 56 are relatively rigid and integrally joined to the central section 54 of the bridge section. These arms straddle the collar rings 38 along their pivot axes 34 and are pivotally joined to the collar rings on their pivot axes by the pivot connections 36. According to a preferred feature of the invention, the entire carrier 12, including the collars 26, bridge section 28, and pivot connections 36, is injection molded as a single integral plastic structure whose pivot connections 36 are torsionally resilient plastic portions extending between and integral with the collar rings 38 and the yoke arms 56.

Figure 5:
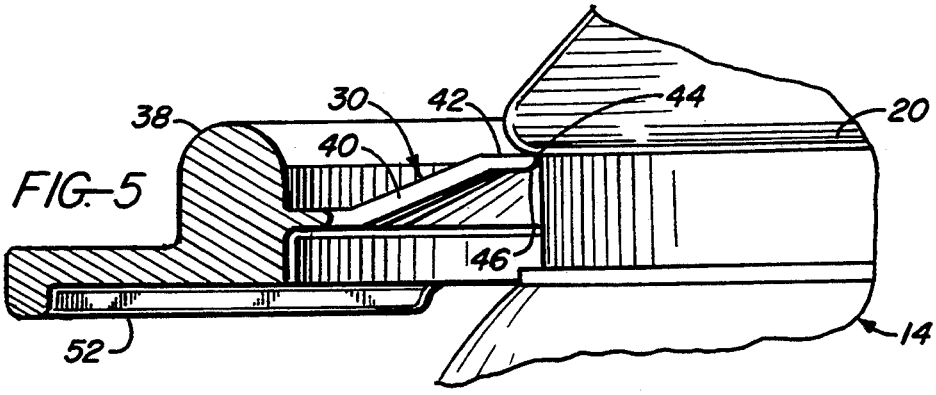
FIG. 5 is an enlargement of the area encircled by the arrow 5—5 in FIG. 4.

The carrier 12 is applied to the containers 14 by coaxially aligning the containers with the carrier collars 26 and then pressing these collars downwardly over the container necks 18 to the positions of FIGS. 1, 3, and 5 wherein the collar segments 30 encircle the container necks and engage the undersides of the container neck rings 20 to vertically support the containers. During this application of the collars 26 downwardly over the container necks, the container caps 22 initially engage the rounded inner lower junctures 46 of the segments 30 and then deflect these segments upwardly and radially outwardly to enlarge the collar openings sufficiently to pass the container neck rings 20. The collar segments then spring back under the neck rings to the positions of FIGS. 1, 3, 5 wherein the upper inner sharp edges 44 of the segments engage the under sides of the neck rings. The stiffness and upward conical taper of the collar segments 30 cooperate to enable the segments to support the containers. The rounded lower junctures 46 of the segments facilitate passage of the container caps and neck rings through the collars. The sharp upper edges 44 of the gripping segments effect firm supporting engagement of the segments with the collar neck rings. Removal of the carrier 12 from each container 14 is accomplished by gripping or squeezing the container cap 22 and corresponding carrier tab 52 between the thumb and forefinger, in the manner shown in FIG. 1, so as to twist the corresponding carrier collar 26 from the container neck.

I claim:

1. A carrier for containers each including an upper neck, said carrier comprising:

a plurality of container holding means for releasably receiving the necks of containers with each holding means receiving the neck of one container and supporting the container by its neck, a relatively rigid bridge section extending between and joining said container holding means by which the carrier may be held to support said carrier in a normal carrying position with a container supported in each said container holding means, and wherein each container holding means comprises pivotal container neck engaging means for engaging in supporting relation the neck of a container, and pivot means joining said neck engaging means and said bridge section, in a manner which permits pivotal movement of said neck engaging means relative to said bridge section, and each neck engaging means is free to pivot at its respective pivot means relative to the other neck engaging means and to said bridge section.

2. A carrier according to claim 1 wherein:

said bridge section is elongated and has opposite ends.

said container holding means are two in number and located at said opposite ends, respectively, of said bridge section, and said pivot means have substantially parallel pivot axes transverse to a common longitudinal plane of said bridge section.

3. A carrier according to claim 1 wherein:

said pivot means comprise torsionally resilient pivot connections between said neck engaging means and said bridge section.

4. A carrier according to claim 1 wherein:

said bridge section comprises arms which straddle said container holding means, respectively, and said pivot means comprise pivot connections extending between and joining said neck engaging means and the adjacent bridge section arms.

5. A carrier according to claim 1 wherein:

said carrier comprises a one piece molded plastic part including said neck engaging means, bridge section, and pivot means.

6. A carrier according to claim 1 wherein:

said neck engaging means of each container holding means comprises an annular collar adapted to be placed over the neck of a container, and said pivot means comprises torsionally resilient pivot connections located at diametrically opposite sides of each collar.

7. A carrier according to claim 1 wherein:

said neck engaging means of each container holding means comprises an annular collar adapted to be placed over the neck of a container, said bridge section includes arms straddling each collar, and said pivot means for each holder comprise pivot connections between each collar and the adjacent bridge section arms.

8. A carrier according to claim 7 including:

a tab projecting outwardly from each collar which, with the upper end of the neck of a container positioned in the collar, may be squeezed between the thumb and fore finger of one hand to remove the collar upwardly from the container neck.

9. A carrier for containers which have an upper neck, and a neck ring having a normally under side circumferentially surrounding said neck, said carrier comprising:

means by which the carrier may be supported in a normal carrying position, at least one annular collar joined to said means and having a central axis, normally upper and lower sides, a relatively rigid ring, and axially resilient segments joined to and circumferentially spaced about said collar ring, and wherein said segments comprise relatively stiff but resiliently flexible, conical segments which incline radially inward toward said axis and axially toward said upper side of the collar and have radially inner edges forming a central opening bounded circumferentially by said segments, said segments having normally upper and lower surfaces which face said upper and lower sides, respectively, of said collar, said upper segment surfaces intersecting said inner segment edges along relatively sharp juncture edges, and said lower segment surfaces joining said inner segment edges along convex rounded junctures, and said collar being adapted to receive a container in a position wherein said collar surrounds the container neck, and the inner ends of said segments engage the under side of said container neck ring to support the container in the collar.

10. A carrier according to claim 9 wherein:

said segments have radially outer conical portions and radially inner flat portions, and said inner flat portions are disposed in a common plane transverse to said axis and terminating in said radially inner segment edges.

11. A carrier for containers including a neck having an upper end, and a neck ring circumferentially surrounding said neck, said carrier comprising:

means by which the carrier may be supported in a normal carrying position, a plurality of container holders joined to said means each including container engaging means and adapted to be placed about a container neck in a position wherein said container engaging means engage the under side of the container neck ring to support the container in the holder.

a tab projecting outwardly from each holder which, with the upper end of the neck of a container positioned in the holder, may be squeezed between the thumb and fore finger of one hand to remove the holder upwardly from the container neck, and wherein said means by which the carrier may be supported in said normal carrying position comprises a bridge section extending between the holders, and means connecting each holder to said bridge section, said carrier has a normal unstressed configuration wherein said holders are disposed to be placed about said container necks in positions wherein said holders are located in vertical supporting relation with the under sides of the container neck rings.

the weight of each container supported in a holder when said carrier is supported by said bridge section in said normal carrying position creates in the portion of said bridge section adjacent the respective holder a bending stress tending to bend said adjacent bridge portion downwardly in a certain bending plane of said bridge section.

said means connecting each holder to said bridge section comprises pivot means having a pivot axis substantially intersecting the axis of the respective holder normal to the bending plane of said bridge section in which the respective adjacent portion of said bridge section tends to bend under the weight of a container supported in the respective holder, whereby said holders can pivot relative to said bridge section during bending of the respective adjacent bridge portions in response to said bending stress to prevent inadvertent twisting of the holders from the necks of containers supported in the holders, and each holder includes a said tab which, with the upper end of the neck of a container supported in the respective holder, may be squeezed between said thumb and fore finger to remove the collar from the container by pivoting the holder on its pivot axis to aid movement of the collar past the container neck ring.

12. A carrier for containers each including an upper neck, said carrier comprising:

a plurality of container holding means each adapted to receive the neck of a container and support the container by its neck and including pivotal neck engaging means for engaging the respective container, a relatively rigid bridge section extending between and joining said container holding means and having arms straddling each container holding means, pivot means connecting said neck engaging means of each container holding means to the adjacent arms of said bridge section for pivotal movement of each neck engaging means relative to said bridge section on a pivot axis, and wherein said carrier is adapted to be supported by said bridge section in a normal carrying position, said carrier has a normal unstressed configuration wherein said container holding means are disposed to be placed axially over the necks of said containers to positions on the containers wherein said neck engaging means are disposed for supporting engagement with the respective container necks, the weight of each container supported in a container holding means of said carrier when said carrier is supported by said bridge section in said normal carrying position tends to bend the portion of said bridge section adjacent the respective container holding means downwardly in a certain plane of said bridge section, and said pivot axis of the pivot means connecting each neck engaging means to said bridge section is substantially normal to said certain plane in which the respective adjacent portion of said bridge section tends to bend under the weight of a container supported in the respective container holding means, and said neck engaging means are free to pivot on their respective pivot axes relative to one another and to said bridge section, whereby when said carrier is supported by said bridge section in said normal carrying position with containers supported in the carrier, said neck engaging means are free to pivot on their respective pivot axes relative to one another and to said bridge section in response to bending of the bridge section by the weights of the containers to prevent inadvertent twisting of the neck engaging means off the container necks.

13. A carrier according to claim 12 wherein:

said bridge section is elongated and has opposite ends, said container holding means are two in number and located at opposite ends of said bridge section, said neck engaging means comprise collars having central axes located in a common longitudinal plane of said bridge section, and said pivot axes intersect said collar axes, respectively, normal to said longitudinal plane.

14. A carrier according to claim 12, wherein:

said carrier comprises a one piece molded plastic part including said neck engaging means, bridge section, and pivot means, and said pivot means comprise torsionally resilient connections integrally joining said bridge section arms to said neck engaging means.

15. A carrier according to claim 12 wherein:

said neck ring engaging means of each container holding means comprises a collar, and said carrier includes a tab projecting outwardly from each collar in a position wherein said tab and the upper end of the neck of a container positioned in the respective collar may be squeezed between the thumb and forefinger of one hand to force the collar upwardly from the respective container neck.

16. A carrier for containers each including an upper neck having a longitudinal axis and a neck ring having a normally under side circumferentially surrounding said neck, said carrier comprising:

annular container-receiving collars each having normally upper and lower sides, a longitudinal axis, a relatively rigid ring coaxial with said collar axis, and resiliently flexible conical segments spaced circumferentially about and joined to said collar ring, a bridge section extending between said collars and having arms straddling each collar, pivot means connecting each collar to the adjacent arms of said bridge section for pivotal movement of each collar relative to said bridge section on a pivot axis transverse to said axis of the respective collar, and wherein said carrier is adapted to be supported by said bridge section in a normal carrying position, said conical segments of each collar incline radially inward toward said axis of the respective collar and axially toward said upper side of the respective collar, said carrier has a normal unstressed configuration wherein said collars are disposed to be placed axially over the necks of said containers when said containers are disposed side by side with their neck axes substantially vertical and to positions on the containers wherein said collars substantially coaxially surround the respective container necks immediately below their neck rings and said conical segments of the collars are disposed for engagement with the under sides of the respective container neck rings to support the containers in the collars, the weight of each container supported in a collar of said carrier when said carrier is supported by said bridge section in said normal carrying position tends to bend the portion of said bridge section adjacent the respective collar downwardly in a certain plane of said bridge section, said pivot axis of the pivot means connecting each collar to said bridge section is substantially normal to said certain plane in which the respective adjacent portion of said bridge section tends to bend under the weight of a container supported in the respective collar, whereby when said carrier is supported by said bridge section in said normal carrying position with containers supported in said collars, said collars are pivotally rotatable on their respective pivot axes relative to said bridge section in response to bending of the bridge section by the weights of the containers to prevent inadvertent twisting of the collars off the container necks, said conical segments of each collar have radially inner edges forming a central opening through the respective collar bounded circumferentially by said segments, conically tapered radially outer portions, flat radially inner portions disposed in a common plane transverse to the respective collar axis and terminating in said radially inner segment edges, normally upper and lower surfaces which face said upper and lower sides, respectively, of the respective collar, and said upper segment surfaces intersect said inner segment edges along relatively sharp corner edges, and said lower segment surfaces join said inner segment edges along rounded convex junctures.

17. A carrier for containers each including an upper neck having a longitudinal axis and a neck ring having a normally under side circumferentially surrounding said neck, said carrier comprising:

annular container-receiving collars each having normally upper and lower sides, a longitudinal axis, a relatively rigid ring coaxial with said collar axis, and resiliently flexible conical segments spaced circumferentially about and joined to the radially inner side of said collar ring, a bridge section extending between said collars and having arms straddling each collar, pivot means connecting each collar to the adjacent arms of said bridge section for pivotal movement of each collar relative to said bridge section on a pivot axis transverse to said axis of the respective collar, and wherein said carrier is adapted to be supported by said bridge section in a normal carrying position, said conical segments of each collar incline radially inward toward said axis of the respective collar and axially toward said upper side of the respective collar, said carrier has a normal unstressed configuration wherein said collars are disposed to be placed axially over the necks of said containers when said containers are disposed side by side with their neck axes substantially vertical and to positions on the containers wherein said collars substantially coaxially surround the respective container necks immediately below their neck rings and said conical segments of the collars are disposed for engagement with the under sides of the respective container neck rings to support the containers in the collars, the weight of each container supported in a collar of said carrier when said carrier is supported by said bridge section in said normal carrying position tends to bend the portion of said bridge section adjacent the respective collar downwardly in a certain plane of said bridge section, said pivot axis of the pivot means connecting each collar to said bridge section is substantially normal to said certain plane in which the respective adjacent portion of said bridge section tends to bend under the weight of a container supported in the respective collar, whereby when said carrier is supported by said bridge section in said normal carrying position with containers supported in said collars, said collars are pivotally rotatable on their respective pivot axes relative to said bridge section in response to bending of the bridge section by the weights of the containers to prevent inadvertent twisting of the collars off the container necks, said bridge section is elongated and has opposite ends, said collars are two in number and located at opposite ends of said bridge section, said collar axes are located in a common longitudinal plane of said bridge section, said pivot axes intersect said collar axes, respectively, normal to said longitudinal plane, said carrier comprises a one piece molded plastic part including said collars, bridge section, and pivot means, said pivot means comprise torsionally resilient connections integrally joining said bridge section arms to diametrically opposite sides of the respective collar rings, said conical segments of each collar have radially inner edges forming a central opening through the respective collar bounded circumferentially by said segments, conically tapered radially outer portions, flat radially inner portions disposed in a common plane transverse to the respective collar axis and terminating in said radially inner segment edges, normally upper and lower surfaces which face said upper and lower sides, respectively, of the respective collar, said upper segment surfaces intersect said inner segment edges along relatively sharp corner edges, and said lower segment surfaces join said inner segment edges along rounded convex junctures, and said carrier includes a tab projecting outwardly from each collar ring in a position wherein said tab and the upper end of the neck of a container positioned in the respective collar may be squeezed between the thumb and fore finger of one hand to force the collar upwardly from the respective container neck.

18. A container package comprising:

a plurality of containers each including an upper neck, a carrier including a plurality of container holding means receiving the necks of said containers with each holding means receiving the neck of one container and supporting the container by its neck, and a relatively rigid bridge section extending between and joining said container holding means by which the carrier may be supported in a normal carrying position, and wherein each container holding means comprises pivotal container neck engaging means engaging in supporting relation the respective container neck, and pivot means joining said neck engaging means and said bridge section, in a manner which permits pivotal movement of said neck engaging means relative to said bridge section, and said neck engaging means are free to pivot at their respective pivot means relative to one another and to said bridge section.

19. A container package according to claim 18 wherein:

said neck engaging means comprise annular container-receiving collars each having a central axis, and the pivot means connecting each collar to said bridge section has a pivot axis substantially normal to and intersecting said central axis of the respective collar.

20. A container package according to claim 19 wherein:

said bridge section is elongated and has opposite ends, said collars are two in number and located at said opposite ends of said bridge section, said collar axes are located in a common longitudinal plane of said bridge section, and said pivot axes intersect said collar axes, respectively, normal to said longitudinal plane.

21. A container package according to claim 18 wherein:

said bridge section is elongated and has opposite ends, said container holding means are two in number and located at said opposite ends of said bridge section.

22. A container package comprising:

a plurality of containers each including an upper neck having a longitudinal axis and a neck ring having a normally under side circumferentially surrounding said neck, a carrier including container holders releasably receiving said container necks below their neck rings and disposed in vertical supporting engagement with said neck rings, a bridge section extending between said holders by which the carrier may be supported in a normal carrying position, and means connecting each holder to said bridge section, and wherein the weight of each container tends to bend the portion of said bridge section adjacent the respective holder downwardly in a certain plane of said bridge section, said means connecting each holder to said bridge section comprises pivot means having a pivot axis normal to said certain plane in which the respective adjacent portion of said bridge section tends to bend under the weight of a container supported in the respective holder, whereby said holders are pivotally rotatable on their respective pivot axes relative to said bridge section in response to bending of the bridge section by the weight of the containers to prevent inadvertent twisting of the holders off the container necks, said container holders comprise annular container-receiving collars each having a central axis, normally upper and lower sides, a relatively rigid ring coaxial with said collar axis, and relatively stiff but resiliently flexible conical segments spaced circumferentially about and joined to said collar ring, said conical segments of each collar incline radially inward toward said axis of the respective collar and axially toward said upper side of the respective collar and are disposed in supporting engagement with the undersides of the respective container neck ring, said pivot axis of the pivot means connecting each holder to said bridge section is substantially normal to and intersects said central axis of the respective holder collar, said bridge section has arms straddling each collar, said pivot means connect each collar to the adjacent arms of said bridge section, said carrier comprises a one piece molded plastic part including said collars, bridge section, and pivot means, said pivot means comprise torsionally resilient connections integrally joining said bridge section arms to diametrically opposite sides of the respective collar, said conical segments of each collar have radially inner edges forming a central opening through the respective collar bounded circumferentially by said segments and receiving the neck of the respective container, conically tapered radially outer portions, flat radially inner portions disposed in a common plane transverse to the respective collar axis and terminating in said radially inner segment edges, normally upper and lower surfaces which face said upper and lower sides, respectively, of the respective collar, said upper segment surfaces intersect said inner segment edges along relatively sharp corner edges engaging the under sides of the respective container neck rings, and said lower segment surfaces join said inner segment edges along rounded convex junctures, and said carrier includes a tab projecting outwardly from each collar ring in a position wherein said tab and the upper end of the neck of a container positioned in the respective collar may be squeezed between the thumb and forefinger of one hand to force the collar upwardly from the respective container neck.

23. A container package according to claim 22 wherein:

said bridge section is elongated and has opposite ends, said collars are two in number and located at said opposite ends of said bridge section, said collar axes are located in a common longitudinal plane of said bridge section, and said pivot axes intersect said collar axes, respectively, normal to said longitudinal plane.

* * * * *